US006430298B1

(12) United States Patent
Kettl et al.

(10) Patent No.: US 6,430,298 B1
(45) **Date of Patent: *Aug. 6, 2002**

(54) MICROPHONE MOUNTING STRUCTURE FOR A SOUND AMPLIFYING RESPIRATOR AND/OR BUBBLE SUIT

(76) Inventors: Lonnie Joe Kettl, 1173 Cordoba Dr., Zachary, LA (US) 70791; James Christopher Mikronis, 7723 S. Maribel, Baton Rouge, LA (US) 70812

( * ) Notice: Subject to any disclaimer, the term of this patent is extended or adjusted under 35 U.S.C. 154(b) by 0 days.

This patent is subject to a terminal disclaimer.

(21) Appl. No.: 08/982,009

(22) Filed: Dec. 1, 1997

Related U.S. Application Data

(63) Continuation-in-part of application No. 08/608,696, filed on Feb. 29, 1996, now Pat. No. 5,860,417, which is a continuation-in-part of application No. 08/372,330, filed on Jan. 13, 1995, now Pat. No. 5,503,141.

(51) Int. Cl.[7] ..... H04R 25/00

(52) U.S. Cl. ..... 381/361; 381/367; 381/376

(58) Field of Search ..... 381/79, 87, 122, 381/338, 344, 361, 367, 375, 376; 181/21, 22; 379/174, 430; 128/201.19, 206.16, 206.17

(56) References Cited

U.S. PATENT DOCUMENTS

| | | | | |
|---|---|---|---|---|
| 2,953,129 A | | 9/1960 | Bloom et al. | 128/146 |
| 2,950,360 A | | 10/1960 | Duncan | 179/146 |
| 3,180,333 A | * | 4/1965 | Lewis | 381/376 |
| 3,314,424 A | | 4/1967 | Berman | 128/142.4 |
| 4,072,831 A | | 2/1978 | Joscelyn | 179/188 |
| 4,116,237 A | | 9/1978 | Birch | 128/142.7 |
| 4,491,699 A | | 1/1985 | Walker | 179/156 R |
| 4,508,936 A | | 4/1985 | Ingalls | 179/82 |
| 4,537,276 A | | 8/1985 | Confer | 181/21 |
| 4,885,796 A | | 12/1989 | Loftus et al. | 381/169 |
| 4,980,926 A | | 12/1990 | Noetzel | 128/201.19 |
| 5,060,308 A | | 10/1991 | Bieback | 359/184 |
| 5,138,666 A | | 8/1992 | Bauer et al. | 381/169 |
| 5,159,641 A | | 10/1992 | Sopoko et al. | 381/169 |
| 5,224,473 A | | 7/1993 | Bloomfield | 128/201.19 |
| 5,307,793 A | | 5/1994 | Sinclair et al. | 128/201.19 |
| 5,428,688 A | | 6/1995 | Beckey et al. | 381/169 |
| 5,503,141 A | | 4/1996 | Kettl et al. | 128/201.19 |

* cited by examiner

*Primary Examiner*—Duc Nguyen
*Assistant Examiner*—Suhan Ni
(74) *Attorney, Agent, or Firm*—Blank Rome Comisky & McCauley LLP

(57) ABSTRACT

A microphone mounting structure for mounting a microphone to a respiratory mask and/or bubble suit through a hole therein. The microphone mounting structure is thus able to convert a conventional respiratory mask and/or bubble suit into a sound amplifying mask and/or bubble suit. The microphone mounting structure comprises a tubular plug and a tubular locking mechanism. The tubular plug has a closed end, an open end and a central portion disposed therebetween. The closed end of the tubular plug has a larger outer diameter than an outer diameter of the central portion. The open end has a plurality of resilient fingers defined by slots in the open end, the resilient fingers having finger tips which project radially outwardly with respect to the tubular plug. The microphone is dimensioned so as to fit coaxially inside the is tubular plug, and preferably, a grommet is provided around the microphone. The tubular locking mechanism has an inner diameter substantially equal to the outer diameter of the central portion and a longitudinal length slightly shorter than a combination of the central portion and the open end. Accordingly, the tubular locking mechanism is slidable over the resilient fingers after the tubular plug is inserted through the hole in the mask. This forces the resilient fingers radially inwardly until the entire tubular locking mechanism has passed over the finger tips of the resilient fingers at which time the finger tips snap outwardly to thereby lock the microphone mounting structure to the respiratory mask/bubble suit. Amplification circuitry is also provided.

10 Claims, 9 Drawing Sheets

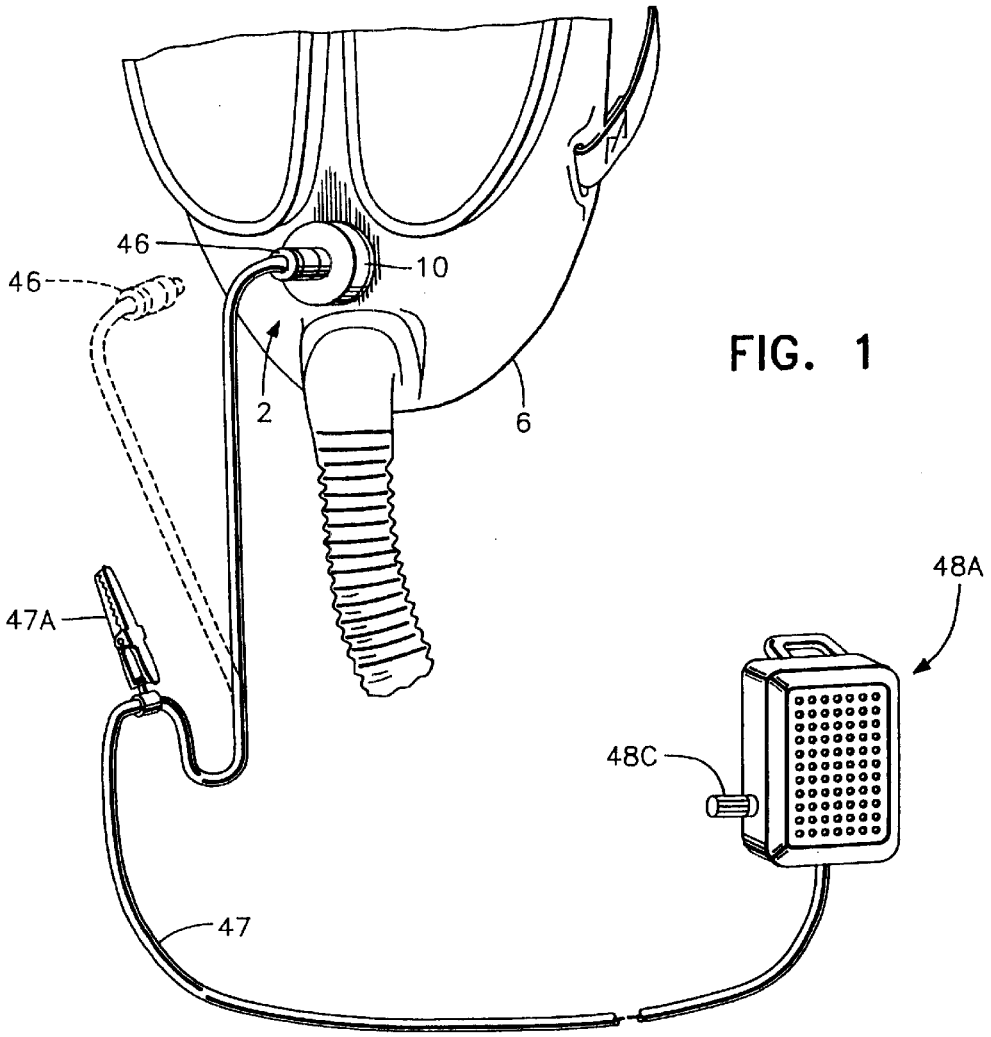
FIG. 1
FIG. 5
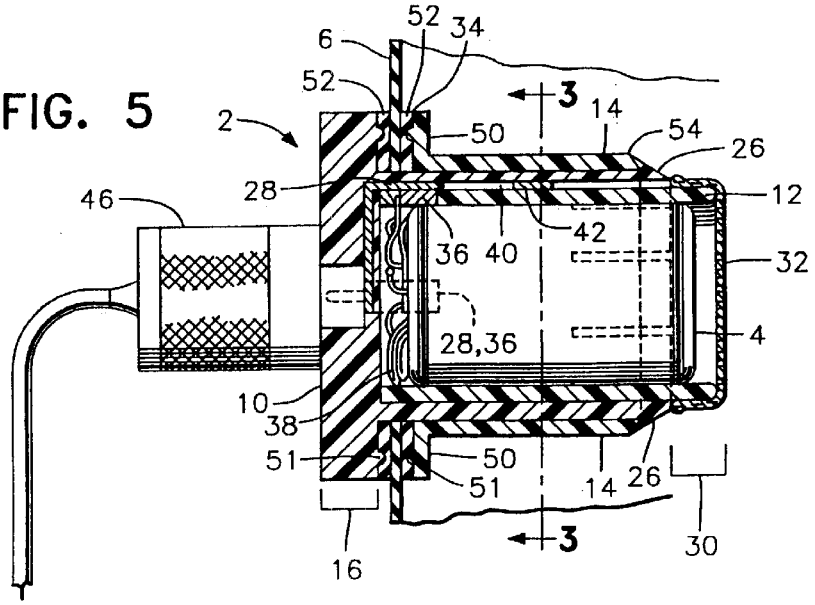

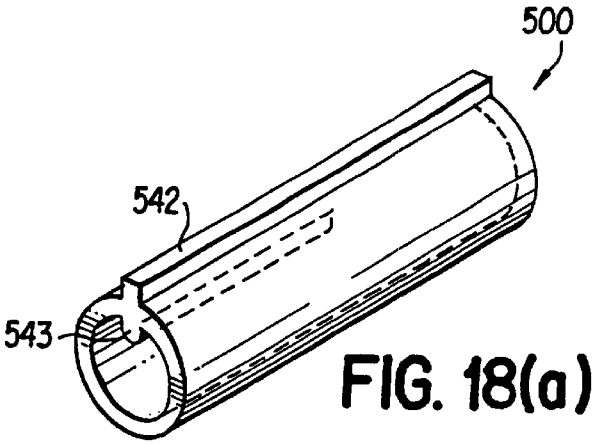
FIG. 18(a)
FIG. 18(b)
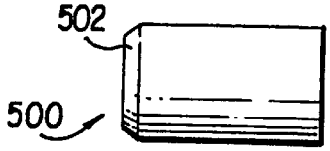
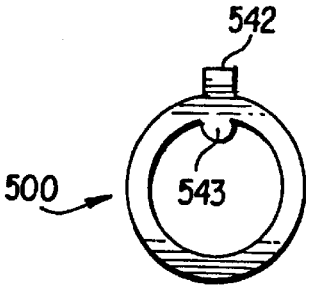
FIG. 19
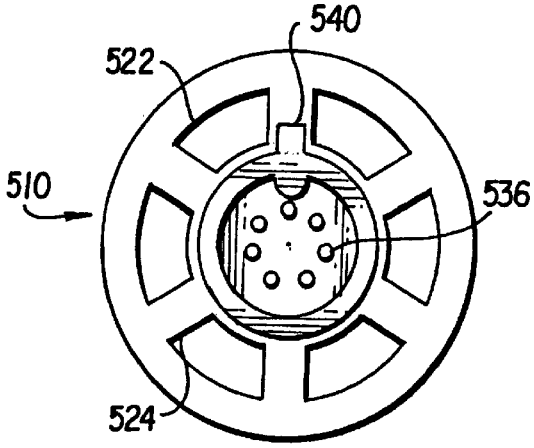
FIG. 20
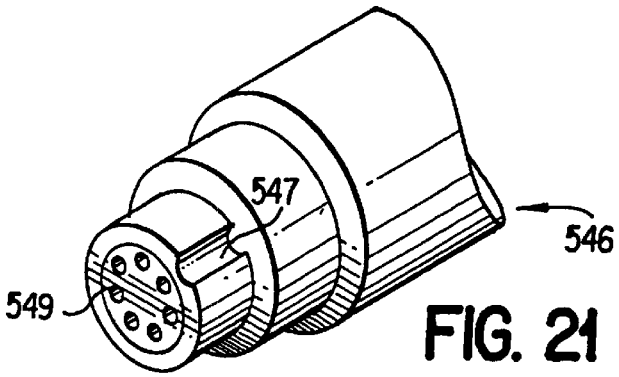
FIG. 21

MICROPHONE MOUNTING STRUCTURE FOR A SOUND AMPLIFYING RESPIRATOR AND/OR BUBBLE SUIT

This is a continuation-in-part of U.S. Ser. No. 08,608,696 now U.S. Pat. No. 5,860,417, filed Feb. 29, 1996, which is a continuation-in-part of U.S. Ser. No. 08,372,330 now U.S. Pat. No. 5,503,141, filed Jan. 13, 1995.

BACKGROUND OF THE INVENTION

The present invention relates to a microphone mounting structure, and in particular, a microphone mounting structure which permits easy and reliable conversion of a conventional respirator and/or bubble suit to a sound amplifying respirator and/or bubble suit.

It is known that conventional respirators and/or bubble suits make communications difficult between persons wearing the respirators and/or bubble suits. In particular, the wearer's voice is muffled and difficult to detect over significant distances. This problem is exacerbated when there is background noise, as during firefighting and other similarly hazardous emergency operations. In response to this problem, several attempts have been made to provide sound amplifying respirators and/or masks which facilitate communications among the wearers of the respirators and masks. Examples of such respirators and masks are illustrated by the following U.S. Patents:

| PATENT NO. | PATENTEE |
|---|---|
| 5,307,793 | Sinclair et al. |
| 5,224,473 | Bloomfield |
| 5,159,641 | Sopko et al. |
| 5,138,666 | Bauer et al. |
| 5,060,308 | Bieback |
| 4,537,276 | Confer |
| 4,508,936 | Ingalls |
| 4,491,699 | Walker |
| 4,116,237 | Birch |
| 4,072,831 | Joscelyn |
| 3,314,424 | Berman |
| 3,180,333 | Lewis |
| 2,953,129 | Bloom et al. |
| 2,950,360 | Duncan |

Although the above exemplary respirators and masks are generally effective, there are several disadvantages associated therewith. The Joscelyn patent, for example, teaches a mounting structure for the microphone which is integrally formed with the mask. Thus, retro-fitting of existing masks with the arrangement of Joscelyn would be very difficult and time-consuming.

Still other disadvantages are associated with one or several ones of the above exemplary respirators and masks. These disadvantages include significant reductions in amplification quality resulting in distortion of the amplified voice; the need for expensive and excessively complex circuitry or manufacturing techniques; serious distortion if the mask is frequently bumped or otherwise subject to frequent quick movements; incompatibility with some irregularly shaped masks and smaller masks, such as filter masks; mounting of the microphone assembly to the mask using a threaded connection which may become loosened during extended use, such loosening of the threaded connection possibly compromising the air-tightness of the mask and thereby posing an extreme danger to the user of the masks in hazardous environments; and difficulty in removing the microphone temporarily from the mask for purposes of cleaning the mask.

SUMMARY OF THE INVENTION

It is a primary object of the present invention to overcome the deficiencies of the prior art by providing a microphone mounting structure which permits easy and reliable conversion of a conventional respirator and/or bubble suit into a sound amplifying respirator and/or bubble suit.

Another object of the present invention is to provide a small, light-weight microphone mounting structure which is compatible with almost any respirator mask, including paper filter masks, and positively locks thereto to prevent inadvertent loosening of the mounting structure or leakage through the mask.

Yet another object of the present invention is to provide a microphone mounting structure which does not require a pre-existing mounting feature or connector on the respirator mask or bubble suit, and instead breaches the mask or bubble suit and then re-establishes the air-tight characteristics thereof.

Still another object of the present invention is to provide a microphone mounting structure which does not require complex or expensive circuitry, nor does it require complex signal transmission means such as infra-red transmitters and receivers.

A further object of the present invention is to provide a microphone mounting structure which provides direct electrical connections between a microphone inside a respirator mask and/or bubble suit, and amplifying circuitry so as to provide enhanced voice signal quality.

Another object of the present invention is to provide a microphone mounting structure with an amplification circuit that provides maximum voice signal quality for voices detected within the mask and/or bubble suit by the microphone.

To achieve these and other objects, the present invention comprises a microphone mounting structure for mounting a microphone to a respiratory mask and/or bubble suit through a hole therein. The microphone mounting structure is thus able to convert virtually any conventional respiratory mask or bubble suit into a sound amplifying respiratory mask or bubble suit.

The microphone mounting structure comprises a tubular plug, a sleeve, and a tubular locking mechanism. The tubular plug has a closed end, an open end and a central portion disposed therebetween. The closed end of the tubular plug has a larger outer diameter than the outer diameter of the central portion. The open end has a plurality of resilient fingers defined by slots in the open end, the resilient fingers having Finger tips which project radially out with respect to the tubular plug. The tubular plug further comprises electrical contact means for electrically connecting an interior of the tubular plug with an exterior of the tubular plug.

The sleeve receives the microphone and has an outer diameter substantially equal to the inner diameter of the tubular plug so that the sleeve fits coaxially inside the tubular plug. Preferably, the sleeve has an internal diameter which matches the outer diameter of the microphone so that the microphone is frictionally retained within the sleeve. The sleeve, however, is preferably longer than the central portion and open end of the tubular plug. In this way, a portion of the sleeve projects out from the tubular plug and this, in turn, facilitates removal of the sleeve from within the tubular plug using, for example, needle-nosed pliers.

A microphone cover may also be provided which fits snugly over the projecting sleeve portion and protects the microphone from moisture, dust, and the like. The microphone cover is preferably arranged only over the projecting sleeve portion so that the resilient fingers of the tubular plug remain exposed for easy inspection.

The tubular locking mechanism cooperates with the tubular plug to lock the microphone mounting structure to the respiratory mask. In particular, the tubular locking mechanism includes an inner diameter substantially equal to the outer diameter of the central portion and a longitudinal length only slightly shorter than the combination of the central portion and the open end. By providing these dimensions, the tubular locking mechanism is slidable over the resilient fingers after the tubular plug has been inserted through the hole in the respiratory mask. Doing so, in turn, forces the resilient fingers radially inwardly until the entire tubular locking mechanism has passed over the finger tips of the resilient fingers, at which time the finger tips snap radially outwardly to thereby lock the microphone mounting structure to the respiratory mask. The respiratory Task, consequently, remains sandwiched and locked between the front end of the tubular locking mechanism and the closed end of the tubular plug.

The microphone mounting structure of the present invention preferably comprises three electrical contacts extending radially through the sleeve and arranged for electrical connection to the electrical contact means in the tubular plug. In addition, three electrical wires are provided for electrically connecting the electrical contacts to the microphone.

The microphone mounting structure preferably also comprises an internal alignment slot extending longitudinally along the central portion and open end of the tubular plug, and an external alignment tab which projects radially out from the sleeve for alignment with the internal alignment slot of the tubular plug. The alignment slot and tab are arranged such that, whenever the external alignment tab is received in the internal alignment slot, the external alignment tab prevents axial rotation of the sleeve with respect to the tubular plug. This arrangement helps keep the three electrical contacts of the sleeve aligned with the electrical contact means of the tubular plug.

Preferably, a socket is also provided at the closed end of the tubular plug. The socket receives an electrical plug which electrically connects the electrical contact means to an amplification circuit.

The microphone mounting structure can further comprise a circumferential flange projecting radially outwardly from the front end of the tubular locking mechanism. At least one resilient washer is preferably disposed coaxially around the central portion of the tubular plug, between the front end of the tubular locking mechanism and the closed end of the tubular plug.

According to a preferred arrangement, at least one and preferably all of the finger tips project radially outwardly and backwardly toward the central portion so that each of the corresponding resilient fingers has a semi-arrow-shaped distal end. In addition, the tubular locking mechanism includes an externally bevelled back end for lockingly engaging the semi-arrow-shaped distal end of the resilient fingers.

Amplification circuitry provides output sounds representative of the oral sounds which the microphone detects within the mask. The amplification circuitry may be provided entirely in a separate housing, or alternatively, may be manufactured using integrated chip technology so that certain circuit components are miniaturized and built into the closed end of the tubular plug. According to the latter arrangement, a speaker and power supply portions of the amplification circuitry would remain in a separate housing.

For purposes of this disclosure, the term "respiratory mask" is intended to broadly encompass all types of respiratory masks, including those attached to a supply of gas and those which merely filter air, including conventional paper filter masks.

An alternative embodiment of the mounting structure requires no sleeve and instead utilizes a microphone having socket sleeves. The socket sleeves are arranged so as to receive electrically conductive pins of the tubular plug and thereby establish electrical communication between the microphone and electrical contacts within the tubular plug. In the alternative embodiment, a grommet may surround the microphone; however, the grommet preferably includes no conductive elements.

The mounting structure of the present invention may be combined with other similar mounting structures disposed through respective holes in a bubble suit (or other protective barrier) to facilitate not only verbal communication through the respiratory mask, but also verbal communication through the bubble suit.

In addition, earphones inside a bubble suit may be electrically connected, via a mounting structure of the present invention, to an external communication device outside the bubble suit. When the external communication device includes a microphone, sounds and conversations which occur outside the bubble suit may be easily detected inside the bubble suit. Similarly, when the external communication device includes a transceiver, bi-directional communication is facilitated between the wearer of the bubble suit and remotely located personnel having similar transceivers.

In another embodiment of the invention, a cylinder is configured as a special sleeve for use with the plug of the alternative embodiment having electrically conductive pins. The cylinder has the same general size and shape as the sleeve, and is essentially used in the same manner. However, the cylinder is capable of receiving either a microphone or an electric plug, whereas the sleeve only receives a microphone.

The above and other objects and advantages will become more readily apparent when reference is made to the following description taken in conjunction with the accompanying drawings.

BRIEF DESCRIPTION OF THE DRAWINGS

FIG. 1 is a perspective view of a microphone mounting structure disposed on a respirator mask and connected to an amplification circuit in accordance with the present invention.

FIG. 5 is a side cross sectional view of the microphone mounting structure illustrated in FIGS. 1–4.

FIG. 18(*a*) is a perspective view of yet another alternative embodiment of a cylinder that is used with the plug of FIG. 7, as illustrated in FIG. 2.

FIG. 18(*b*) is a side view of the cylinder of FIG. 18(*a*).

FIG. 19 is a front view of the cylinder of FIG. 18(*a*)

FIG. 20 is a front view of a tubular plug, together with the cylinder of FIG. 18(*a*).

FIG. 21 is a perspective view of an electrical plug used with the cylinder of FIG. 18(*a*).

DETAILED DESCRIPTION OF THE PREFERRED EMBODIMENTS

Figure 2:
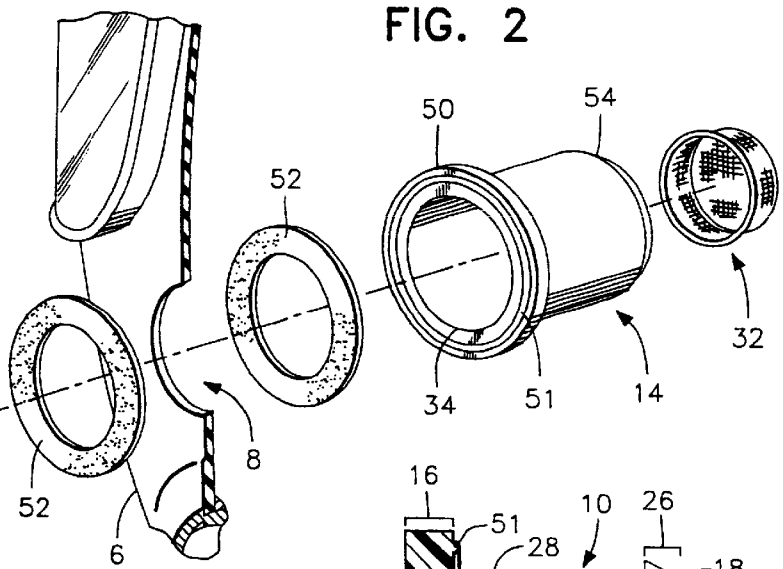
FIG. 2 is an exploded view of the microphone mounting structure illustrated in FIG. 1.
Figure 3:
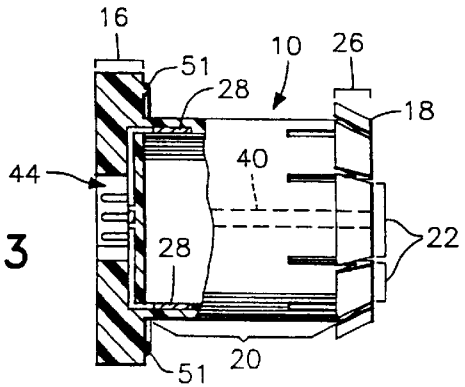
FIG. 3 is a top partially cross sectioned view of a tubular plug in accordance with the present invention.
Figure 4:
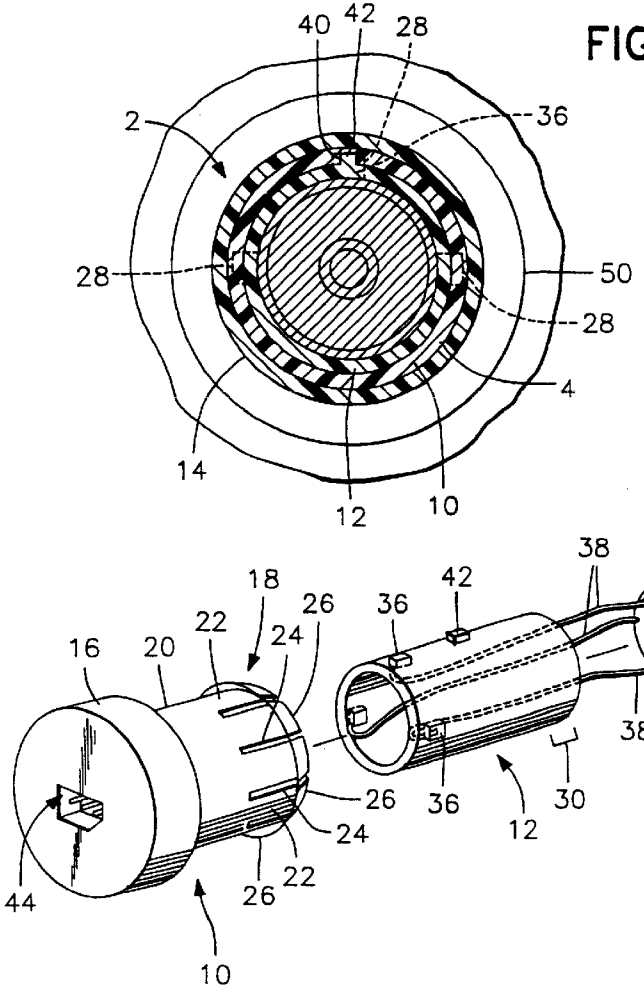
FIG. 4 is a cross section of the microphone mounting structure in accordance with the present invention.

A preferred embodiment of the present invention will now be described with reference to FIGS. 1–6.

According to the preferred embodiment, a microphone mounting structure 2 is provided for :mounting a microphone 4 to a respiratory mask 6. All that is required to effect mounting of the mounting structure 2 to the respiratory mask 6 is a hole 8 in the respiratory mask 6. Such a hole 8 can be easily cut or drilled through an existing conventional respiratory mask at any convenient location in the mask 6. It is preferably mounted in the front near the wearer's mouth. Accordingly, the microphone mounting structure 2 is able to convert virtually any conventional respiratory mask into a sound amplifying respiratory mask 6.

The microphone mounting structure 2 comprises a tubular plug 10, a sleeve 12, and a tubular locking mechanism 14. The tubular plug 10, sleeve 12, and tubular locking mechanism 14 are all made from non-conductive material, preferably a moldable plastic such as ZYTEL which is a commercially available high temperature nylon thermoplastic resin manufactured by DuPont. The tubular plug 10 has a closed end 16, an open end 18 and a central portion 20 disposed therebetween. The closed end 16 of the tubular plug 10 has a larger outer diameter than the outer diameter of the central portion 20. The open end 18 has a plurality of resilient fingers 22 defined by slots 24 in the open end 18, the resilient fingers 22 having finger tips 26 which project radially outwardly with respect to the tubular plug 10. The tubular plug 10 further includes electrical contact means 28 for electrically connecting the interior of the tubular plug 10 with the exterior of the tubular plug 10.

The sleeve 12 has an outer diameter substantially equal to the inner diameter of the tubular plug 10 so that the sleeve 12 fits coaxially inside the tubular plug 10. These dimensions preferably provide frictional retention of the sleeve 2 inside the tubular plug 10.

In addition, the sleeve 12 preferably has an internal diameter which matches the outer diameter of the microphone 4 so that the microphone 4 remains frictionally retained within the sleeve 12. The sleeve 12 is preferably longer than the combination of the central portion 20 and open end 18 in the tubular plug 10. In this way, portion 30 of the sleeve 12 projects out from the tubular plug 10 and this, in turn, facilitate removal of the sleeve 12 from within the tubular plug 10 using, for example, needle-nosed pliers.

A microphone cover 32 may also be provided which fits snugly over the projecting sleeve portion 30 and protects the microphone 4 from moisture, dust, and the like. The microphone cover 32 is preferably arranged only over the projecting sleeve portion 30 so that the resilient fingers 22 of the tubular plug 10 remain exposed for easy inspection. According to a preferred embodiment, the microphone cover 32 is made using water-impermeable high density cloth or water-impermeable tightly woven cloth.

The tubular locking mechanism 14 cooperates with the tubular plug 10 to lock the microphone mounting structure 2 to the respiratory mask 6. In particular, the tubular locking mechanism 14 includes an inner diameter substantially equal to the outer diameter of the central portion 20 and a longitudinal length only slightly shorter than the combination of the central portion 20 and the open end 18. By providing these dimensions, the tubular locking mechanism 14 is slidable over the resilient fingers 22 after the tubular plug 10 has been inserted through the hole 8 in the respiratory mask 6. Doing so, in turn, forces the resilient fingers 22 radially inwardly until the entire tubular locking mechanism 14 has passed over the finger tips 26 of the resilient fingers 22, at which time the finger tips 26 snap radially outwardly to thereby lock the microphone mounting structure 2 to the respiratory mask 6. The respiratory mask 6, consequently, remains sandwiched and locked between a front end 34 of the tubular locking mechanism 14 and the closed end 16 of the tubular plug 10.

The sleeve 12 preferably includes three electrical contacts 36 extending radially through the sleeve 12 and arranged for electrical connection to the electrical contact means 28 in the tubular plug 10. Preferably, frictional retention of the sleeve 12 within the tubular plug 10 is enhanced by the friction which exists between the three electrical contacts 36 in the sleeve 12 and the contact means 28 of the tubular plug 10. In addition, three electrical wires 38 are provided for electrically connecting the three electrical contacts 36 to the microphone 4 in any convenient, known manner.

The microphone 4 is preferably a commercially available ELECTRECT condenser microphone, sold commercially by Panasonic. The microphone 4 is responsive to oral sounds within the respiratory mask 6, and produces electrical signals indicative of these oral sounds. The microphone 4 is electrically connected to electrical contact means 28 using the three wires 38 so that these electrical signals will be provided to the contact means 28.

The plug 10 also preferably includes an internal alignment slot 40 extending longitudinally along the inner surface of central portion 20 and open end 18 of the tubular plug 10, and an external alignment tab 42 which projects radially outwardly from the sleeve 12 for alignment with the internal alignment slot 40 of the tubular plug 10. The alignment slot 40 and tab 42 are arranged such that, whenever the external alignment tab 42 is received in the internal alignment slot 40, the external alignment tab 42 prevents axial rotation of the sleeve 12 with respect to the tubular plug 10. This arrangement advantageously helps keep the three electrical contacts 36 of the sleeve 12 aligned with the electrical contact means 28 of the tubular plug 10.

Preferably, a socket 44 is Provided at the closed end 16 of the tubular plug 10. The socket 44 receives an electrical plug 46 which, in combination with an electrical cable 47, electrically connects the electrical contact means 28 to an amplification circuit 48 shown schematically in FIG 6. The electrical cable 47 may include an alligator clip 47A which engages an article of clothing to support the weight of the cable 47. This arrangement would be helpful in preventing inadvertent disconnection of the plug 46 from the socket 44 and stress failure of the connection between the cable 47 and the plug 46. In addition, the electrical cable 47 preferably consists of a commercially available, shielded electrical cable to thereby prevent the pick-up of a static hum on the cable 47.

According to a preferred use of the present invention, the separate housing 48A is secured to a shoulder of a user's clothing to thereby facilitate communications using a telephone, radio, or intercom system, any one or all of which may be found in nuclear and other industrial plants. Clear concise communications will increase wearer or user safety and, in groups, will add synergy and reduce work time in hazardous environments, thereby reducing exposure to such hazardous environments.

The amplification circuit 48 provides output sounds representative of the oral sounds which the microphone 4 detects within the mask 6. The amplification circuit 48 may be disposed entirely in a separate housing 48A, or alternatively, may be manufactured using integrated chip technology so that certain circuit components are miniaturized and built into the closed end 16 of the tubular plug 10. According to the latter arrangement, a speaker U3 and power supply portion 48B of the amplification circuit 48 would remain in the separate housing 48A, primarily due to their size.

The separate housing 48A can include an ON/OFF and volume control knob 48C, as is generally known, for turning the amplification circuit 48 on and off and for controlling gain in the amplification circuit 48 to thereby effect volume control. The separate housing 48A also includes a battery compartment, as is generally known, for removably storing batteries which power the amplification circuit 48. The knob 48C and battery compartment each include gaskets which maintain an air-tight seal between the interior and exterior of the separate housing 48A. Preferably, any element which breeches the separate housing 48A is equipped with a similar gasket. This way, the contents of the separate housing 48A remain free from environmental contamination.

The separate housing 48A preferably further includes warning labels which provide instructions regarding the recommended use and non-recommended use of the sound amplifying respirator. One such label, for example, would warn a user not to connect or disconnect the battery in an explosive environment.

Figure 6:
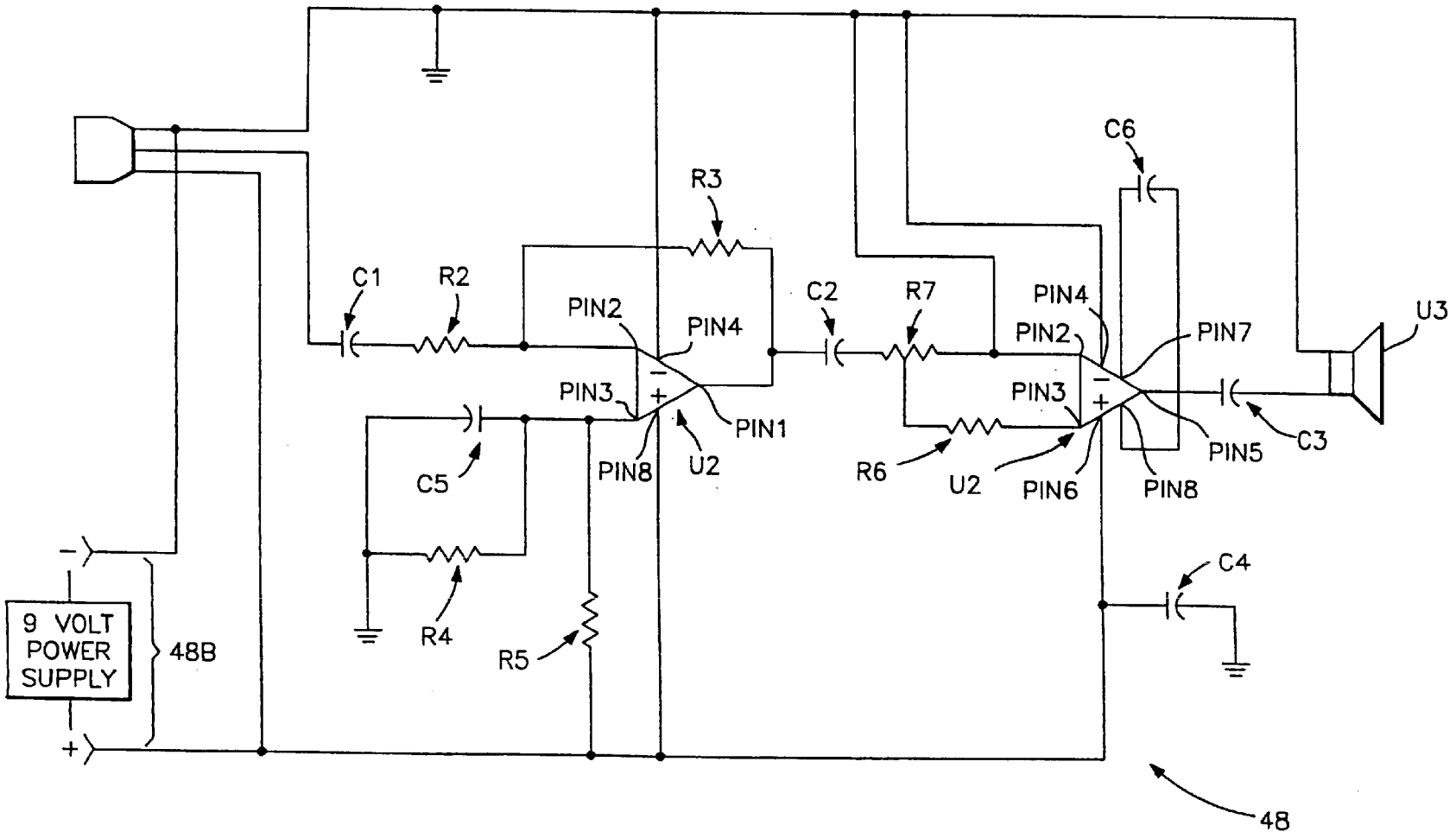
FIG. 6 is a circuit diagram of an amplification circuit for the microphone mounting structure of the present invention.

Although a preferred amplification circuit 48 is illustrated in FIG. 6, it is well understood that many other amplifications circuits will suffice. In addition, the amplification circuit 48 can be modified, for example, to include a voice actuation circuit to thereby conserve battery power, as is generally known. The following table correlates the reference numeral for each element In amplification circuit 48, with the details thereof:

| REF. No. | DETAILS OF CIRCUIT ELEMENTS FROM AMPLIFICATION CIRCUIT 48 |
|---|---|
| 4 | ELECTRECT condenser microphone |
| C1 | Audio coupling using a 0.022 μfarad non-polarized film capacitor |
| C2 | Audio coupling using a 0.05 μfarad non-polarized film capacitor |
| C3 | Coupling power to speaker using a 47 μfarad polarized aluminum capacitor |
| C4 | Power supply filter capacitor having a 47 μfarad capacitance |
| C5 | Audio bypass capacitor which provides a 0.1 μfarad bias for the preamplifier U1 |
| C6 | Gain is increased to 200 using a 10 μfarad polarized aluminum capacitor |
| R2 | 1 KΩ input limiting resistor |
| R3 | 10 KΩ negative feedback resistor |
| R4 | 100 KΩ bias resistor to ground |
| R5 | 100 KΩ bias resistor to a positive power supply terminal |
| R6 | 270 Ω input limiting resistor |
| R7 | 10 KΩ potentiometer for providing volume control |
| U1 | 625 milliwatt preamplifier, an example of which is commercially available under part number LM1458 IC |
| U2 | 1 watt power amplifier, an example of which is commercially available under part number LM386N-1 IC |
| U3 | Speaker (preferably, 1 watt, and 2 inch diameter) |

A significant portion of the amplification circuit 48 is commercially available from MCM TechKit of Centerville, Ohio, and is listed under audio amplifier number AA-1. The amplifier circuit 48 illustrated in FIG. 6, however, includes several modifications which make the circuit 48 particularly well suited for amplification of voices in a respiratory mask. In particular, the capacitors C1, C2, C5 and C6 have been chosen so as to provide a frequency response highly conducive to amplifying the human voice from within a respiratory mask. Preferably, the low frequencies associated with breath sounds are attenuated, while the higher frequencies associated with the human voice are amplified.

The pin designations in FIG. 5 relate to the particular amplifier integrated chips listed in the above table. It is understood that such pin designations may be different depending on the particular amplifier chips used. In addition, as FIG. 6 indicates, the amplifier circuit 48 is particularly adapted to operate from a 9 volt power supply, and according to the preferred embodiment, from a conventional 9 volt battery.

The microphone mounting structure 2 can further include a circumferential flange 50 projecting radially out from the front end 34 of the tubular locking mechanism 14. The flange 50 advantageously provides a greater surface area squeezing the mask 6 between the tubular locking mechanism 14 and the large-diameter closed end 16 of the tubular plug 10. Preferably, the large-diameter closed end 16 of the tubular plug 10 and the circumferential flange 50, each have a projection 51 which is arranged so as to bite the mask 6. Each projection 51 is preferably coextensive with the flange 50 and the large-diameter closed end 16 of the tubular plug 10. This overall arrangement helps prevent stretching of the hole 8 in the mask 6 beyond the circumference of the mounting structure 2 and consequently prevents any undesirable leaks which might otherwise develop. The flange 50 therefore provides a more secure structural arrangement and a more reliable air-tight seal.

At least one resilient washer 52 is preferably disposed coaxially around the central portion 20 of the tubular plug 10, between the front end 34 of the tubular locking mechanism 14 and the closed end 16 of the tubular plug 10. The number of resilient washers 52 and their respective thicknesses depend primarily upon the resiliency and thickness of the mask 6 itself. Thick masks having a high resiliency typically need no washers 52, while thinner and less resilient masks may require one or more washers 52. The washers 52 are preferably made of neoprene rubber, or similar resilient materials which are capable of withstanding exposure to hostile environments.

According to a preferred arrangement, there are between six and eight fingers 22 in the tubular plug 10. Experiments with other numbers of fingers have yielded more brittle parts or an otherwise less effective locking arrangement. Nevertheless, such parts may be effective in limited applications of the microphone mounting structure 2, which applications would fall well within the scope and spirit of the present invention.

One and preferably all of the finger tips 26 project radially outwardly and backwardly toward the central portion 20 so that each of the corresponding resilient fingers 22 has a semi-arrow-shaped distal end. In addition, the tubular locking mechanism 14 includes an externally bevelled back end 54 for lockingly engaging the semi-arrow-shaped distal ends of the resilient fingers 22. This locking arrangement, once secured to the mask 6, advantageously prevents inadvertent loosening of the mounting structure 2.

A preferred method for securing the microphone mounting structure 2 to the respiratory mask 6 will now be described. Initially, the hole 8 is created at a desired mounting position on the mask 6. The hole 8 may be created in any known manner, including cutting and drilling, and is preferably made by pressing a sharp circular cutting element against a firm surface with the mask 6 sandwiched therebetween. The diameter of the sharp cutting element substantially matches the outside diameter of the central portion 20 of the tubular plug 10 so that the hole 8 will be of proper size.

Once the hole 8 has been created, the tubular plug 10 can be inserted into the hole 8, starting from outside of the mask 6 and penetrating the hole 8 toward the inside of the mask 6. It is understood that any resilient washers which are to remain on the outside of the mask 6, will be mounted circumferentially around the central portion 20 prior to insertion of the tubular plug 10 into the hole 8. Insertion of the tubular plug 10 continues until the closed end 16 of the tubular plug 10 abuts against the outside surface of the mask 6, or against a washer 52 disposed therebetween.

Next, any washers 52 which are to be mounted on an inside surface of the mask 6 are mounted circumferentially around the tubular plug 10 and then brought into contact with the inside surface of the mask 6. After the washers 52 are appropriately positioned, the tubular locking mechanism 14 is brought into axial alignment with the tubular plug 10 inside of the mask 6. This axial alignment is achieved such -hat the flange 50 faces the tubular plug 10. With the flange 50 facing the tubular plug 10, the locking mechanism 14 is brought against the finger tips 26 and then pressed toward the mask 6. This pressing action causes a radially inward displacement of the resilient fingers 22 which permits the tubular locking mechanism 14 to pass over the central portion 20 of the tubular plug 10 and into contact with the mask 6, or alternatively, into contact with a washer 52 disposed against the inside surface of the mask 6.

The tubular locking mechanism is then pressed harder against the mask 6 to cause compression of the mask 6 and/or resilient washers 52. Such compress-on permits the externally bevelled back end 54 of the locking mechanism 14 to pass beyond the finger tips 26 thus releasing the finger tips 26. Once released, the resilient fingers 22 snap outwardly so that the finger tips 26 lockingly engage the bevelled back end 54 of the tubular locking mechanism 14. This locking arrangement is securely maintained by the cooperating shapes of the finger tips 26 and the externally bevelled back end 54, combined with the back pressure exerted by the mask 6 and/or washers 52 by virtue of their compressed state. It is noted that, upon locking the foregoing elements as indicated above, the air-tight characteristic of the respiratory mask 6 is re-established.

This air-tight characteristic Pan be tested in non-filter masks by placing the mask over one's :ace, holding closed any air hoses to the mask 6, and subsequently inhaling. Confirmation of the air-tight characteristics will be evidenced by the ability to suck the mask into one's face. Likewise, the finger tips 26 of the resilient fingers 22 always remain exposed for visual verification of the locking arrangement.

Next, the microphone 4 is inserted into the sleeve 12 so that the sleeve 12 frictionally retains the microphone 4. The wires 38 are preferably pre-connected to respective ones of the electrical contacts 36; however, it is understood that a separate connector can be provided for making connections in the field. The microphone cover 32 is then mounted to the projecting sleeve portion 30.

Thereafter, the sleeve 12 is axially aligned with the tubular plug 10 inside the mask 6, and is rotationally positioned so that the external alignment tab 42 aligns with the internal alignment slot 40 of the tubular plug 10. Once the tab 42 and slot 40 are properly aligned, the sleeve 12 is forced into the open end 18 of the tubular plug 10 and driven therein until only the projecting sleeve portion 30 remains exposed. At this point, the sleeve 12 and the microphone 4 are frictionally retained inside the tubular plug 10, with the electrical contacts 36 engaging the electrical contact means 28 of the tubular plug 10. In this position, the sleeve 12 prevents the resilient fingers 22 from bending radially inwardly. This advantageously provides added security against inadvertent release of the tubular locking mechanism 14.

The microphone 4 is thus securely mounted to the mounting respiratory mask E. Thereafter, the microphone 4 can be electrically connected to the amplification circuit 48 by connecting the electrical plug 46 to the socket 44 of the tubular plug 10.

A particularly advantageous feature of the microphone mounting structure 2 is the ability to remove the combination of the microphone 4 and sleeve 12, while leaving the tubular plug 10 and the tubular locking mechanism 14 mounted to the mask 6. When the mask 6 is then washed, for example, the projecting sleeve portion 30 may be gripped using any suitable means and pulled to remove the combination of the sleeve 12, microphone 4, and microphone cover 32 out from the tubular plug 10 as a unit. Thereafter, the mask 6 can be washed without fear of damaging the microphone 4.

In the preferred structure, according to the present invention, the elements which seal the hole 8 (i.e., the tubular plug 10, tubular locking mechanism 14, and washers 52) remain attached to the mask 6, while the microphone 4 and sleeve 12 are readily removable. Further, once the seal is established by the former elements, there is no need to again break this seal to remove the microphone 4. This advantageously prevents repetitious wearing of the critical elements that establish and maintain the mask's seal. An enhanced level of safety is thereby provided.

With reference to FIGS. 7–11, an alternative embodiment of the microphone mounting structure will now be described.

According to the alternative embodiment, the microphone mounting structure is used for mounting a microphone 104 to a respiratory mask 6 (shown in FIG. 2) through a hole 8 (also shown in FIG. 2) in the respiratory mask 6. In particular, the microphone mounting structure includes a tubular plug 110 for receiving the microphone 104 and a tubular locking mechanism 114.

The tubular plug 110 is very similar to that of the previously described embodiment, and Includes a closed end 116, an open end 118 and a central portion 120 disposed therebetween. The closed end 116 has a larger outer diameter than an outer diameter of the central portion 120, and the open end 118 has a plurality of resilient fingers 122 defined by slots 124 in the open end 118. The resilient fingers 122 have finger tips 126 which project radially outwardly with respect to the tubular plug 110. Additionally, the tubular plug 110 includes electrical contacts 136 for electrically connecting an interior of the tubular plug 110 with an exterior of the tubular plug 110.

The tubular locking mechanism 114 has an inner diameter substantially equal to the outer diameter of the central portion 120 and a longitudinal length slightly shorter than a combination of the central portion 120 and the open end 118. The tubular locking mechanism 114 is slidable over the resilient fingers 122 after the tubular plug 110 is inserted through the hole in the respirator mask to thereby force the resilient fingers 122 radially inwardly until the entire tubular locking mechanism 114 has passed over the finger tips 126 of the resilient fingers 122 at which time the finger tips 126 snap radially outwardly to thereby lock the microphone mounting structure to the respiratory mask. The respiratory mask therefore remains linked between a front end 134 of the tubular locking mechanism 114 and the closed end 116 of the tubular plug 110.

Preferably, a circumferential flange 150 projects radially outwardly from the front end 134 of the tubular locking mechanism 114. The flange 150 advantageously provides a greater surface area squeezing the mask between the tubular locking mechanism 114 and the large-diameter closed end 116 of the tubular plug 110. At least one resilient washer may be placed coaxially around the central portion 120, as indicated in the previously described embodiment, between the front end 134 of the tubular locking mechanism 114 and the closed end 116 of the tubular plug 110.

Figure 11:
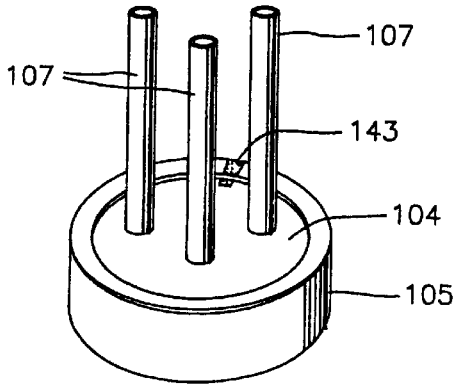
FIG. 11 is a perspective view of a microphone and grommet in accordance with the alternative embodiment of the present invention.
Figure 12:
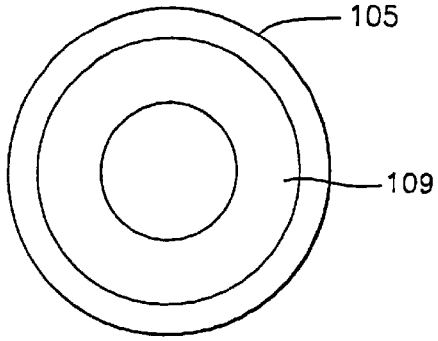
FIG. 12 is a top view of the grommet illustrated in FIG. 11.

The microphone 104 of the alternative embodiment is illustrated, by way of example, in FIG. 11. Preferably, a grommet 105 is placed around the microphone 104. The grommet 105 has an outer diameter substantially equal to an inner diameter of the tubular plug 110 so that the grommet 105 and the microphone 104 snugly fit coaxially inside the tubular plug 110. Preferably, the grommet 105 is made of resilient material capable of cushioning the microphone 104 and preferably has an internal diameter which matches an outer diameter of the microphone 104 so that the microphone 104 is frictionally retained within the grommet 105. The grommet 105 is generally cup-shaped and has an annular bottom 109, as illustrated in FIG. 12.

Alternatively, the grommet 105 may be eliminated by manufacturing the tubular plug 110 with an inner diameter which matches the outer diameter of the microphone 104 so that the microphone 104 is frictionally retained by the inside wall of the tubular plug 110.

Preferably, the electrical contacts 136 include electrically conductive pins projecting into the interior of the tubular plug 110. The electrically conductive pins are arranged for insertion into correspondingly arranged socket sleeves 107 of the microphone 104 when the microphone 104 is contained within the tubular plug 110. Electrical communication is thereby established between the electrical contacts 136 and the microphone 104. A grommet 105 and a microphone 104 of the type illustrated are commercially available from DIGI-KEY Corporation and are currently sold under part numbers P9950-ND and P9970-ND, respectively. The commercially available microphone, however, has two solder connections instead of the socket sleeves 107 illustrated in FIG. 11. Accordingly, the microphone 104 of the alternative embodiment is created by soldering the socket sleeves 107 to the solder connections of the commercially available microphone.

Preferably, at least three socket sleeves 107 are soldered to the commercially available microphone, with two of the socket sleeves 107 being soldered to the same solder connection of the commercially available microphone, and the remaining one of the socket sleeves 107 being soldered to the other solder connection of the microphone. The use of at least three such socket sleeves 107 and three electrically conductive pins is preferred because of the resistance such an arrangement presents against bending of the electrically conductive pins and socket sleeves 107 during disconnection and interconnection of the sleeves 107 and electrically conductive pins.

In order to facilitate proper connection of the microphone 104 to the electrically conductive pins of the electrical contacts 136, a first alignment mark 142 is located at the open end 118 of the tubular plug 110 for alignment with a second alignment mark 143 associated with the microphone 104 and/or grommet 105. In particular, the first alignment mark 142 is arranged so that the electrically conductive pins are properly aligned with the socket sleeves 107 only when the first and second alignment marks 142,143 are aligned.

Figure 9:
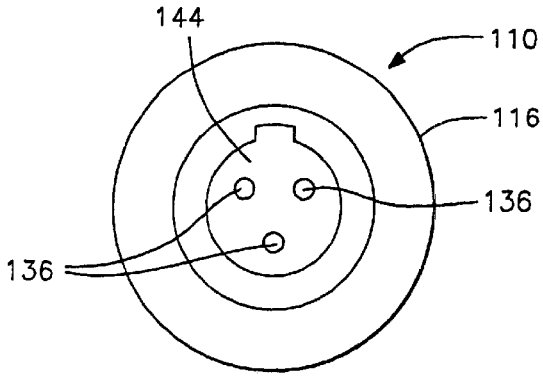
FIG. 9 is an exterior view of the tubular plug illustrated in FIG. 7.

As illustrated in FIG. 9, a socket 144 is preferably located at the closed end 116 of the tubular plug 110. The socket 144 is arranged so as to receive an electrical plug which electrically connects the electrical contacts 136 to the amplification circuit 48.

Figure 13:
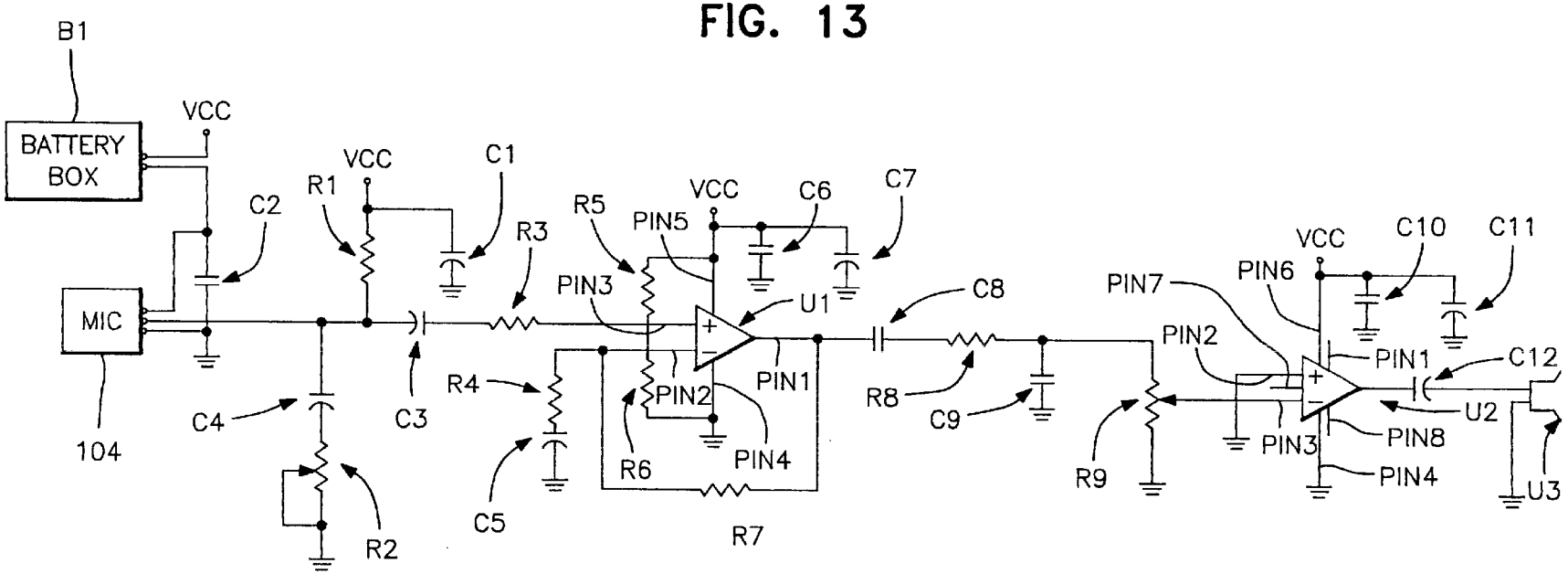
FIG. 13 is a circuit diagram of an alternative amplification circuit for the microphone mounting structure of the present invention.

Although a preferred amplification circuit 48 is illustrated in FIG. 6, it is well understood that many other amplifications circuits will suffice. An alternative amplification circuit 48 is illustrated in FIG. 13. The following table correlates the reference numeral for each element in the alternative amplification circuit 48 of FIG. 13, with the details thereof:

| REF. No. | DETAILS OF CIRCUIT ELEMENTS FROM ALTERNATIVE AMPLIFICATION CIRCUIT 48 |
|---|---|
| 104 | Microphone commercially available from DIGI-KEY Corp.: Part No. P9970-ND |

-continued

| REF. No. | DETAILS OF CIRCUIT ELEMENTS FROM ALTERNATIVE AMPLIFICATION CIRCUIT 48 |
|---|---|
| C1 | 470 μfarad capacitor; commercially available from DIGI-KEY Corp.: Part No. P6335-ND |
| C2, C6, C5, C9, C10 | 0.1 μfarad capacitor commercially available from DIGI-Key Corp.: Part No. P4525-ND |
| C3, C4, C5 | 1.0 μfarad capacitor: commercially available from DIGI-KEY Corp.: Part No. P2105-ND |
| C7, C11, C12 | 100 μfarad capacitor: commercially available from DIGI-KEY Corp.: Part No. P2019-ND |
| R1 | 2.2 KΩ-ND Resistor commercially available from DIGI-KEY Corp. |
| R2, R9 | 10.KΩ-ND potentiometer commercially available from DIGI-KEY Corp. R2 provides an adjustable cut-off frequency for a filter defined by the combination of R2 and C4. R9 provides volume control. |
| R3, R8 | 1 kΩ-ND Resistor commercially available from DIGI-KEY Corp. |
| R5, R6, R7 | 100 KΩ-ND Resistor commercially available from DIGI-KEY Corp. |
| U1 | TL082 Dual Operating Amp commercially available from Motorola. The pin designations and the connection of these pins to various circuit elements are illustrated in the drawing. |
| U2 | LM386 amplifier chip commercially available from National Semiconductor |
| U3 | Mylar speaker commercially available from CUI/Stack, Inc. of Beaverton, Oregon: Part. No. 45-8B-04 |
| B1 | Battery holder commercially available from DIGI-KEY Corp.; Part No. BH9V-PC-ND |
| R4 | 10KΩ-ND Resistor commercially available from DIGI-KEY Corp. |

It is noted that the illustrated alternative embodiment does not include the externally bevelled back end 54 associated with the previous embodiment for engaging semi-arrow-shaped distal ends of the resilient fingers 26. Instead, the back end 154 of the tubular locking mechanism 114 is flat, as are the bottoms of the finger tips 126. The latter arrangement advantageously reduces manufacturing costs by avoiding the expense associated with creating the bevelling and the semi-arrow shaped distal ends in the previous embodiment.

In the illustrated embodiment, the tubular plug 110 does not include the projection 51 illustrated in connection with the previously illustrated embodiment (FIGS. 1–6). Although such a projection can be provided, it is preferably omitted to avoid additional manufacturing costs.

The microphone mounting structure of the alternative embodiment is utilized in much the same way as the previously recited embodiment. The only differences lie in the insertion of the microphone 104 into the tubular ping 110. In the alternative embodiment, there is no sleeve 12. Instead, the microphone 104 itself or the combination of the microphone 104 and its associated grommet 105 are inserted into the tubular plug with the first and second alignment marks 142,143 properly aligned. This way, the socket sleeves 107 receive the contact pins of the electrical contacts 136. Once the microphone 104 is inserted, the microphone 104 prevents the resilient fingers 122 from bending radially inwardly. This advantageously provides added security against inadvertent release of the tubular locking mechanism 114.

The microphone 104 is thus securely mounted to the respiratory mask 6. Thereafter, the microphone 104 can be electrically connected to the amplification circuit 48 by connecting an electrical plug 146, illustrated in FIG. 14, to the socket 144 of the tubular plug 110. The electrical plug 146 preferably comprises a three-contact straight female plug of the type commercially available from Switchcraft, Inc. under part numbers ST603 or TA3FL, and is connected to an electrical cord 147 leading to the amplification circuit 48. The electrical cord 147 is preferably a multi-wire shielded cable assembly.

Figure 14:
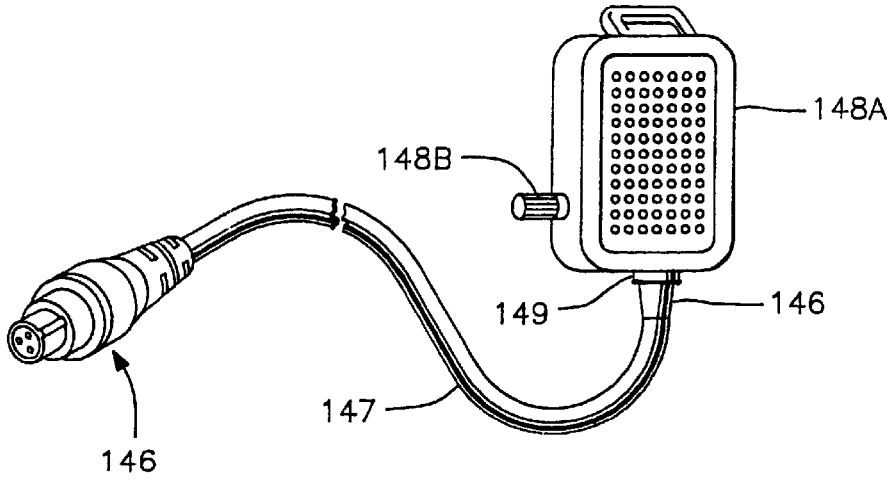
FIG. 14 is a perspective view of a preferred arrangement for electrically connecting the alternative amplification circuit illustrated in FIG. 13 to the tubular plug illustrated in FIG. 9.

As illustrated in FIG. 14, the amplification circuitry is preferably contained in a separate housing 148A. The separate housing 148A can include an ON/OFF and volume control knob 148B, as is generally known, for turning the amplification circuit 48 on and off and for controlling gain in the amplification circuit 48 to thereby effect volume control. An exemplary environmentally sealed box from which the separate housing 148A can be manufactured is commercially available from Bud West under Part No. PN-1321-DG.

The separate housing 148A also includes a battery compartment, as is generally known, for removably storing batteries which power the amplification circuit 48. A preferred battery compartment is commercially available from DIGI-KEY Corp. under Part No. BH9V-PL-ND.

The knob 148B and battery compartment each include gaskets which maintain an air-tight seal between the interior and exterior of the separate housing 148A. Preferably, any element which breeches the separate housing 148A is equipped with a similar gasket. This way, the contents of the separate housing 148A remain free from environmental contamination.

Preferably, as illustrated in FIG. 14, the separate housing 148A includes a three-pin male receptacle connector 149, and each distal end of the electrical cord 147 includes one of the three-contact straight female plugs 146. One of the plugs 146 may be removably connected to the socket 144 of the tubular plug 110, while the other plug 146 is removably connected to the three-pin male receptacle connector 149. An exemplary three-pin male receptacle connector 149 is commercially available from Switchcraft, Inc. under part number TB3M.

In a preferred alternative arrangement, the three-pin male receptacle connector 149 provides a protective seal from the external environment, an example of which is commercially available from Electroshield, Inc. of Yellow Springs Ohio, under Part No. 17282-3PG-300. When this alternative three-pin male receptacle connector is used, one of the three-contact straight female plugs 146 of the electrical cord 147 is preferably a sealed connector commercially available from Electroshield, Inc., under Part No. 16282-3SG-315.

The separate housing 148A preferably further includes warning labels which provide instructions regarding the recommended use and non-recommended use of the sound amplifying respirator. One such label, for example, would warn a user not to connect or disconnect the battery in an explosive environment.

Figure 15:
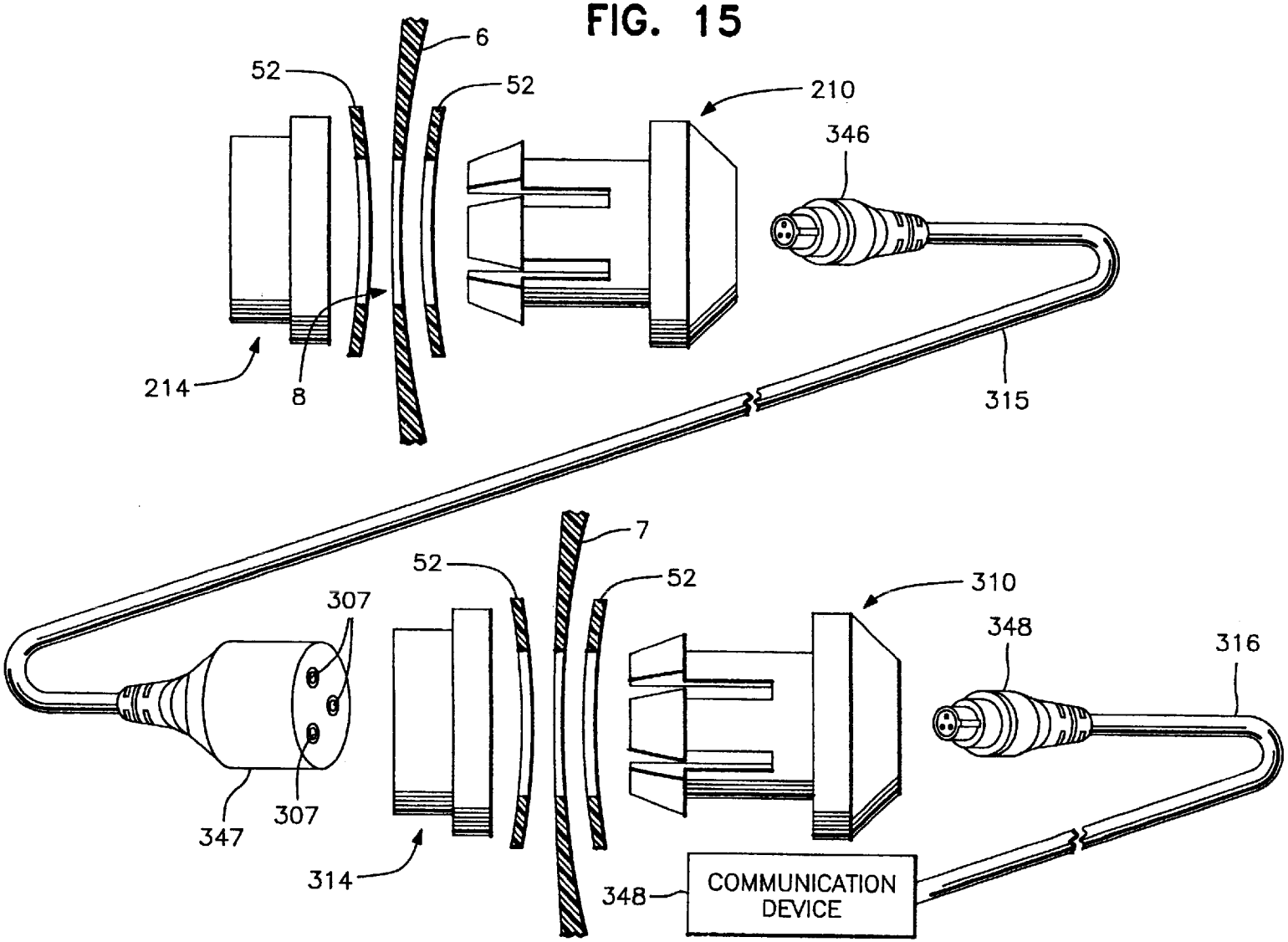
FIG. 15 is a schematic illustration of yet another preferred embodiment of the present invention, -which embodiment is adapted for use in conjunction with a bubble suit or other protective barrier.

Yet another preferred embodiment of the present invention will now be described with reference to FIG. 15. In FIG. 15, the respirator mask 6 is being utilized in conjunction with a bubble suit 7, or other protective outer barrier.

Such utilization of a protective outer barrier, such as a bubble suit 7, is generally known in the art of handling hazardous materials. The preferred embodiment schematically illustrated in FIG. 15 greatly facilitates oral communication through the respirator mask 6 and bubble suit 7 by providing a microphone mounting structure extending through a hole 8 in the respirator mask and by also providing an additional mounting structure extending through a hole in the bubble suit 7. The additional mounting structure electrically connects the microphone mounting structure at the respirator mask 6 to a communication device 348.

The communication device 348 may include an amplification circuit similar to the amplification circuits illustrated in FIGS. 6 and 14, or alternatively, may include a transmitter or transceiver for communicating with remotely located communication equipment.

The arrangement illustrated n FIG. 15 includes a first tubular plug 210, a first tubular locking mechanism 214, a second tubular plug 310, a second tubular locking mechanism 314, and an electrical cord 315 electrically connecting the first tubular plug 210 to the second tubular plug 310. The first and second tubular plugs 210,310 are preferably identical to the tubular plug 110 illustrated in FIGS. 7–9. Likewise, the first and second tubular locking mechanisms 214,314 are preferably identical to the tubular locking mechanism 114 illustrated in FIG. 10.

During assembly, resilient washers 52 are preferably disposed coaxially around the central portion of each tubular plug 210,310 between the front end of the tubular locking mechanisms 214,314 and the closed end of the tubular plugs 210,310. The number of resilient washers 52 and their respective thicknesses depend primarily upon the resiliency and thickness of the mask 6 and the bubble suit 7. Masks and bubble suits which are thick and/or have high resiliency characteristics typically need no washers 52, while thinner and less resilient masks and bubble suits may require one or more washers 52. The washers 52 are preferably made of neoprene rubber, or similar resilient materials which are capable of withstanding exposure to hostile environments.

Attachment of the microphone mounting structure and the additional mounting structure to the mask 6 and bubble suit 7, respectively, is achieved in the same manner is in the previously described embodiments. Once the tubular locking mechanisms 214,314 are brought over the resilient fingers of tubular plugs 210,310 the two mounting structures are locked in place. Thereafter, insertion of the microphone into the first tubular plug 210 prevents inward displacement of the resilient fingers of the tubular plug 210 and thereby precludes inadvertent unlocking of the microphone mounting structure.

In order to establish electrical communication between the microphone and the communication device 348 external of the bubble suit 7, the socket at the closed end of the first tubular plug 210 is electrically connected to the electrically conductive pins inside the first tubular plug 210. A first electrical plug 346 has a configuration which matches the socket of the first tubular plug 210 and is received in the socket. Preferably, the first electrical plug 346 is identical to the three-contact straight female plugs 146 described in connection with the previous embodiment.

The first electrical plug 346 defines one distal end of the electrical cord 315. The other distal end of the electrical cord 315 includes a second electrical plug 347. The second electrical plug 347 has dimensions similar to that of the microphone and therefore is received in place of the microphone in the additional mounting structure. Preferably, the dimensions of the tubular plug 110 and the socket 144 thereof are such that the first electrical plug 346 and the second electrical plug 347 are identical.

The second electrical plug 347 slides into the second tubular plug 310 and electrically connects to the electrically conductive pins inside the second tubular plug 310. Preferably, a set of conductive socket sleeves 307 inside the second electrical plug 347 provide the electrical connection between the conductive pins inside the second tubular plug 310 and the electrical cord 315.

Upon insertion of the second electrical plug 347 into the second tubular member 310, inward displacement of the resilient fingers of the second tubular plug 310 is prevented, and this, in turn, precludes inadvertent unlocking of the additional mounting structure from the bubble suit 7.

A third electrical plug 348 has a configuration which matches the socket of the second tubular plug 310 and is received in the socket of the second tubular plug 310 to establish electrical communication with the electrically conductive pins in the second tubular plug 310. Preferably, the third electrical plug 348 is identical to the three-contact straight female plugs 146 described in connection with the previous embodiment.

Extending from the third electrical plug 348 is another electrical cord 316 which is electrically connected to the communication device 348 located externally of the protective barrier defined by the bubble suit 7.

The embodiment illustrated in FIG. 15 also preferably includes the grommet 105 described in connection with the embodiment of FIGS. 7–14.

Figure 17:
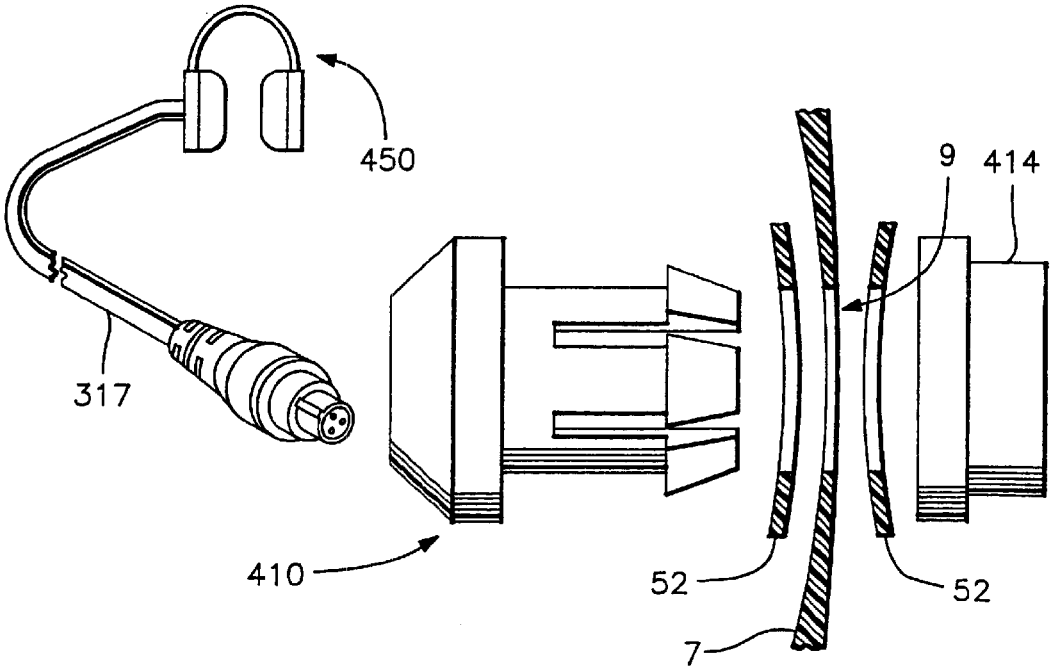
FIG. 17 illustrates an alternative modification to that illustrated in FIG. 16.
Figure 16:
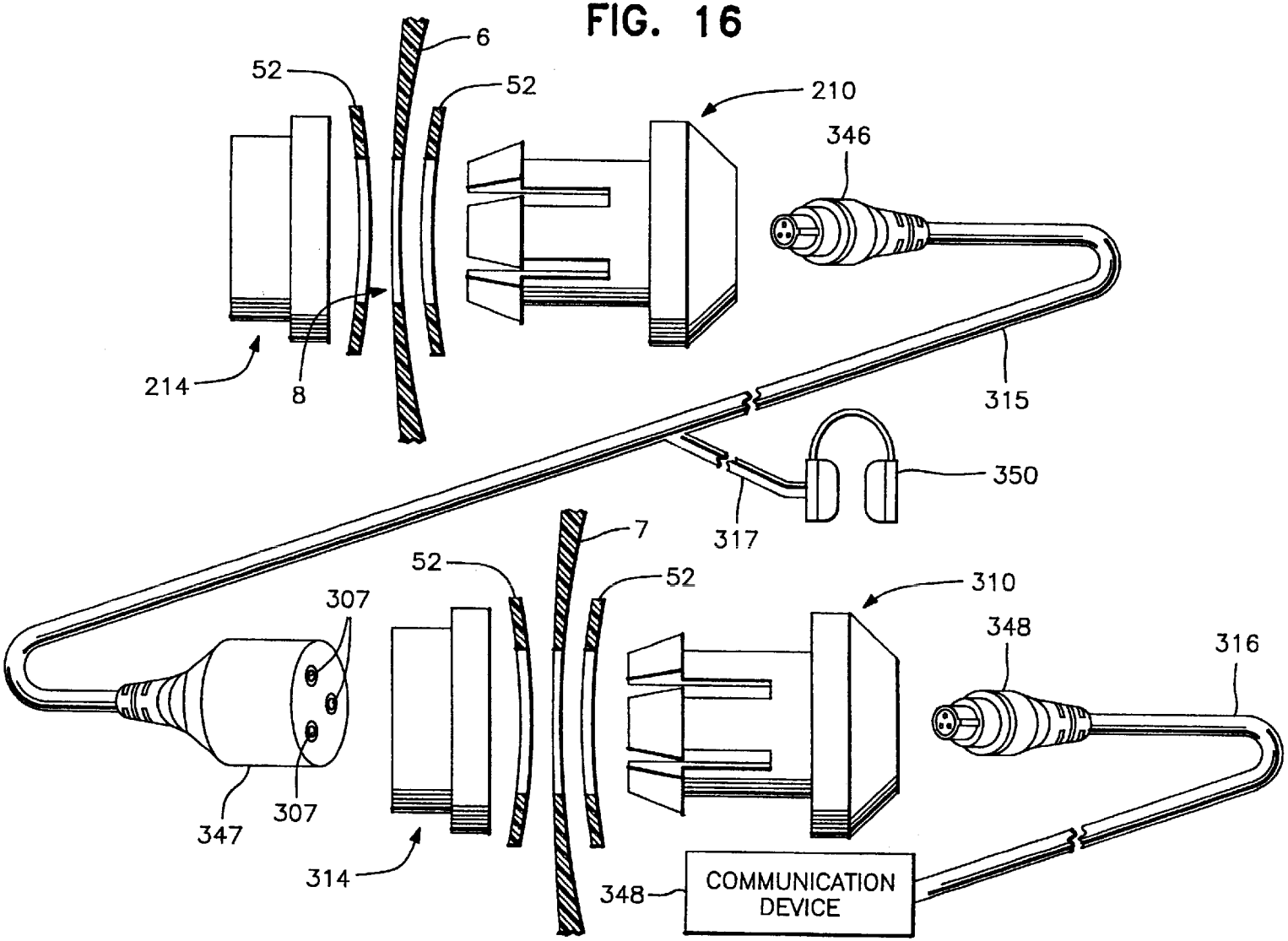
FIG. 16 schematically illustrates a modification of the embodiment illustrated in FIG. 15, which modification includes an earphone.

To further facilitate communications through the respiratory mask 6 and bubble suit 7, the embodiment illustrated in FIG. 15 may be augmented with an earphone 350 as schematically illustrated in FIGS. 16 and 17.

In FIG. 16, the electrical cord 315 is bifurcated and therefore also includes an earphone cable 317 which electrically connects the earphone 350 via the second electrical plug 347 to the electrically conductive pins of the second tubular plug 310.

It is understood that the second electrical plug 347 and second tubular plug 310 may include additional pins and conductors to that illustrated.

Preferably, at least two of the electrically conductive pins of the second tubular plug 310 define a dedicated audio conductor set for transmitting audio signals to the earphone 350. These audio signals may be derived from an external microphone located at the communication device 348, or alternatively, the audio signals may be derived from radio signals and/or other signals containing audio information which are received by the communication device 348 from a remote location.

In FIG. 17, in order to avoid bifurcation of the electrical cord 315, the microphone mounting structure includes a third tubular plug 410, a third tubular locking mechanism 414, a microphone for insertion into the tubular plug 410 outside of the bubble suit 7, and an earphone cord 317 for electrically connecting the electrically conductive pins of the third tubular plug 410 to the earphones 450. The third tubular plug 410 and the third tubular locking mechanism 414 are identical to the tubular plug 110 and tubular locking mechanism 114 of FIGS. 7–10.

In FIG. 17, however, these elements are mounted in the reverse direction with the tubular plug 410 entering a hole 9 in the bubble suit from outside the bubble suit 7 and with the tubular locking mechanism located inside the bubble suit. Such reverse mounting is desired because the microphone must remain outside of the bubble suit 7 to pick up oral signals outside of the bubble suit 7, while the earphone cord 317 remains inside the bubble suit 7 to permit wearing of the earphone 450 inside the suit 7.

The earphone 450 preferably includes an amplification circuit similar to that illustrated in FIG. 13. Alternatively, the microphone can be mounted in a separate communication device, as shown in FIG. 16, and a plug similar to the plug 347 in FIG. 16 may be provided to electrically connect the separate communication device to the electrically conductive pins of the tubular plug 410 via the interior of the tubular plug 410.

According to yet another alternative embodiment, the separate communication device may include an audio receiver for receiving radio or other signals containing audio information from remote locations and for communicating these signals to the earphones 350 via the tubular plug 410 and earphone cord 317.

According to a preferred embodiment of the communication device 348, the communication device 348 includes a radio transmitter for transmitting radio signals containing audio information derived from the microphone mounted inside the respiratory mask 6 and further includes a radio receiver for receiving radio signals containing audio information from a remote location. In addition, the radio receiver is electrically connected to the earphone (either 350 or 450) via dedicated audio conductors in the tubular plug (either 310 or 410) which penetrates the bubble suit 7. This way, audio signals indicative of the audio information from the remote location can be transmitted to the earphone (350 or 450), to thereby enable reception of the audio information by a person wearing the earphone in the bubble suit 7.

It is understood that some bubble suits utilize an external air supply connected to the bubble suit via a life-line commonly referred to as an "umbilical cord". Such bubble suits do not require respirator masks. Instead, the person in the bubble suit may be provided with a head-set which, in turn, includes both a microphone placed near the mouth and at least one earphone for placement in or adjacent to the wearer's ear(s). Such head-sets are generally known, especially in the telephony arts (e.g., head-sets for telephone operators and office receptionists).

The present invention advantageously facilitates electrical communication between such a head-set and a communication device such as microphones and amplification circuitry located externally of the bubble suit. When such an arrangement is used, there is no need for three different mounting structures (one in the respirator and two in the bubble suit). Instead, using the arrangement illustrated in FIG. 17, the earphones of the head-set may be electrically connected to the external microphone or other communication device located externally of the bubble suit so that sounds and conversations which occur outside the bubble suit are transmitted into the suit and heard via the earphones of the head-set. The arrangement of FIG. 17 advantageously includes only one mounting structure.

In addition, the head-set's microphone is preferably electrically connected directly to the plug 346 shown in FIG. 15 thereby eliminating the need for the tubular plug 210 and tubular locking mechanism 214 which, according to the embodiment illustrated in Figure IS, passes through the respirator mask. The arrangement of FIG. 17 therefore, when combined with some element from FIG. 15, also allows oral communication from inside the bubble suit to be transmitted outside the bubble suit.

By combining the embodiments of FIG. 15 and 17 as indicated above, verbal communications is greatly facilitated between a person inside a mask-free bubble suit and persons outside the suit.

In an alternative embodiment for facilitating verbal communications between a person inside a mask-free bubble suit and persons outside the suit, the embodiment of FIG. 15 is made with more than three electrically conductive paths from the plug 346 to the communication device 348 (including the tubular plug 310 and tubular locking mechanism 314. The number of conductive paths depends primarily on the number necessary to support transmission of audio signals from the head-set's microphone to the communication device 348 and also from the communication device 348 to the head-set's earphone. This arrangement advantageously requires no additional tubular plug 210 and no additional tubular locking mechanism 214. Instead, the head-set includes a jack capable of receiving the plug 346 so as to electrically connect the conductive paths to respective terminals of the head-set's earphone and microphone.

It is also understood that, when the bubble suit requires no respiratory mask, any of the microphone mounting structures illustrated in FIGS. 1–14 may be located through a hole in the bubble suit so that the microphone is mounted inside the bubble suit to the suit itself.

FIG. 18(*a*) shows a cylinder 500 configured to be used with the systems of FIGS. 7–17. Cylinder 500 has the same general shape and size as sleeve 12 of FIG. 2. Cylinder 500 has an outer diameter substantially equal to the inner diameter of the tubular plug 510 so that the cylinder 500 fits coaxially inside the tubular plug 510. As shown in FIG. 18(*b*), one end of the cylinder is slightly chamfered 502 in order that the cylinder 500 be more easily inserted into plug 510.

In addition, the cylinder 500 has an internal diameter that matches the outer diameter of a microphone 104 (FIG. 11) or an electrical plug 546 (FIG. 21), so that the microphone 104 or plug 546 is frictionally retained within the cylinder 500. The cylinder 500 is preferably of the same length as, or shorter than, the central portion 120 and open end 118 (FIG. 7) of the tubular plug 510. The slost 524 of tubular plug 510 extend all the way to the floor of the tubular plug 510. In this way, the cylinder 500 extends from the bottom a of pins 536 on the inside of tubular plug 510 to the ends of fingers 522. Thus, the cylinder 500 lies flush with the end of the tubular plug 510 and allows for a better connection between tubular plug 510 and electric plug 546 or microphone 104.

Figure 7:
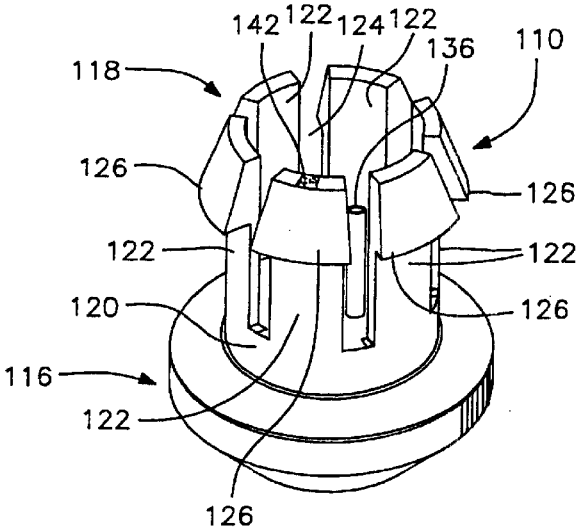
FIG. 7 is a perspective view of a tubular plug in accordance with an alternative embodiment of the present invention.
Figure 10:
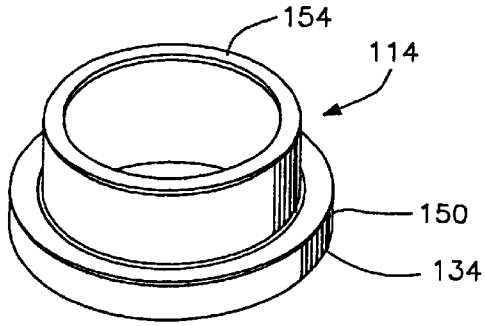
FIG. 10 is a perspective view of a locking mechanism in accordance with the alternative embodiment of the present invention.
Figure 8:
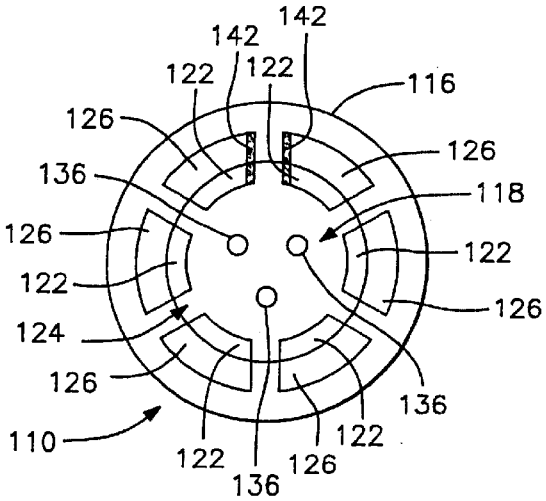
FIG. 8 is a interior view of the tubular plug illustrated in FIG. 7.

Referring to FIG. 20, tubular plug 510 is essentially the same as the tubular plug 110 of FIGS. 7–9. An alignment mark 540 is located, for purposes of illustration, at one of the spaces or slots 524 between fingers 522, to indicate a position of alignment for plug 510 and cylinder 500. However, plug 510 preferably now has seven (7) electric contact pins 536, though more or less pins 536 may be provided. The three pin configuration is preferably used, for example, with a respirator.

As shown in FIGS. 18 and 19, cylinder 500 has an orientation lug 542 projecting radially outwardly from the external surface of the cylinder 500. The exterior lug 542 and slot 540 are arranged such that, whenever the external lug 542 is received in the alignment slot 540, the lug 542 prevents axial rotation of the cylinder 500 with respect to the tubular plug 510.

The exterior lug 542 preferably extends the entire length of the cylinder 500 to provide added stability. However, the exterior lug 542 may also be a short fragment located at any point along the cylinder 500, though preferably located at the center on the exterior of the cylinder 500.

As further shown in FIG. 19, cylinder 500 has an additional orientation lug 543 projecting radially inward from the internal surface of the cylinder 500. As shown in FIG. 21, the electrical plug 546 has an orientation slot 547 that extends longitudinally along the outer surface of the plug 546. Thus, the internal lug 543 and slot 547 are arranged such that, whenever the internal lug 543 is received in the orientation slot 547 of the electrical plug 546, the lug 543 prevents axial rotation of the cylinder 500 with respect to the plug 546.

In the preferred embodiment, the internal lug 543 is shown as having a curved cross-section. However, the lug 543 may be configured in any shape that corresponds to the shape of orientation slots 547 located in conventional electrical plugs 547. For instance, the internal lug may be replaced by a slot that receives a projection located on an electrical plug. The internal lug 543 preferably extends about one-half the length of the cylinder 500 and lies flush with the end of the cylinder 500.

In addition, the internal lug 543 is located directly opposite the exterior lug 542. This is done so that the electrical contact pins 536 of tubular plug 510 are directly aligned with the corresponding female contact receptacles 549 of the electrical plug 546. Thus, the exterior and interior lugs 542, 543 of the cylinder 500 cooperate with the slot 540 of the tubular plug 510 and the exterior slot 547 of the electrical plug 546, respectively.

Further, when the electrical plug 546 receives the tubular plug 510, the lugs 542, 543 and slots 540, 547 prevent rotation of the electrical plug 546 with respect to the tubular plug 510. This, in turn, prevents the pins 536 from breaking off when inserted in female receptacles 549.

Likewise, cylinder 500 and plug 510 may be fitted with microphone 104, as opposed to electrical plug 546. In this case, the socket sleeves 107 of microphone 104 are aligned with the pins 536 of plug 510. Preferably the microphone has the same number of sleeves 107 as the number of pins 536 on plug 510, though there may be fewer sleeves 107 than pins 536. Accordingly, cylinder 500 is capable of receiving either microphone 104 or an electrical plug 546.

A microphone mounting structure 2 having plug 510 and cylinder 500 is assembled as follows. First, the tubular plug 510 is inserted into a hole 8 in a mask 6 or suit and a locking mechanism 114 is compressed over the plug 510 until the fingers 522 snap outwardly so that the finger tips engage the locking mechanism 114, as described more fully above in relation to the other embodiments of the invention.

Next, the cylinder 500 is axially aligned with the tubular plug 510 by aligning the exterior lug 542 of the cylinder 500 with the slot 540 of the plug 510. The plug 510 and locking collar are compressed together, along with any gaskets located therebetween, so as to reduce any collapse of the fingers 522 and ease insertion of the cylinder 500. The cylinder 500 is then inserted into the plug 510, starting with the chamfered end 502 of the cylinder 500. Once inserted, the cylinder 500 prevents the resilient fingers 522 from bending radially inward.

Once the cylinder 500 is in place, the user may selectively insert and remove either a microphone 104, electrical plug 546, or any other device that is connectable to pins 536 of tubular plug 510. The electrical plug 546, for instance, may be connected with an amplifier, two-way radio, headphones, or other electrical device. Thus, the invention may be configured in a variety of shapes and sizes and is not limited by the dimensions of the preferred embodiment.

The present embodiment is advantageous in that the assembly provides a ready access to any conventional electrical component. Once the cylinder 500 is in place, the user need not plug in a component until the system is to be used. In addition, the cylinder 500 aligns pins 536 of tubular plug 510 with the female receptacles 549 of the electrical plug 546 or the sleeves 107 of microphone 107.

While the present invention has been described with reference to the above preferred embodiments and drawings, it is understood that the invention is not limited to these embodiments. For example, numerous variations of, and modifications to, the above embodiments will become subsequently apparent, which variations and modifications fall well within the scope and spirit of the present invention. Accordingly, it is understood that the present invention is limited only by the scope of the appended claims.

What is claimed is:

1. A mounting structure for electrically connecting a microphone located on a first side of a protective barrier to a communication device located on an opposite side of said protective barrier, through a hole in the protective barrier, said mounting structure comprising:

a tubular plug for receiving conductive means which are electrically connected to said microphone, said tubular plug having a closed end, an open end and a central portion disposed therebetween, said closed end having a larger outer diameter than an outer diameter of the central portion, said open end having a plurality of resilient fingers defined by slots in said open end of the tubular plug, said resilient fingers having finger tips which project radially outwardly with respect to the tubular plug, said tubular plug having electrical contact means for electrically connecting an interior of said tubular plug with an exterior of said tubular plug; and a tubular locking mechanism having an inner diameter substantially equal to the outer diameter of said central portion and a longitudinal length slightly shorter than a combination of said central portion and said open end, said tubular locking mechanism being slidable over said resilient fingers after said tubular plug is inserted through said hole to thereby force said resilient fingers radially inwardly until the entire tubular locking mechanism has passed over the finger tips of the resilient fingers at which time the finger tips snap radially outwardly to thereby lock said mounting structure to the protective barrier, the protective barrier being locked between a front end of said tubular locking mechanism and the closed end of the tubular plug.

2. The mounting structure of claim 1, wherein said electrical contact means include electrically conductive pins projecting into the interior of said tubular plug, said electrically conductive pins being arranged for insertion into correspondingly arranged socket sleeves of said conductive means when said conductive means are contained within said tubular plug.

3. The mounting structure of claim 1, wherein said tubular plug is dimensioned so as to accommodate said microphone and said conductive means.

4. The mounting structure of claim 1, further comprising:

a second tubular plug having a closed end, an open end and a central portion disposed therebetween, said closed end of the second tubular plug having a larger outer diameter than an outer diameter of the central portion of the second tubular plug, said open end of the second tubular plug also having a plurality of resilient fingers defined by slots in said open end of the second tubular plug, said resilient fingers of the second tubular plug having finger tips which project radially outwardly with respect to the second tubular plug, said second tubular plug having second electrical contact means for electrically connecting an interior of said second tubular plug with an exterior of said second tubular plug, said interior of the second tubular plug being configured so as to receive an audio signal from said communication device when electrically connected to said interior of the second tubular plug and so as to transmit said audio signal to the second electrical contact means;

a second tubular locking mechanism having an inner diameter substantially equal to the outer diameter of said central portion of the second tubular plug and a longitudinal length slightly shorter than a combination of said central portion and said open end of the second tubular plug, said second tubular locking mechanism being slidable over said resilient fingers of the second tubular plug after said second tubular plug is inserted through a hole in said protective barrier to thereby force said resilient fingers radially inwardly until the entire second tubular locking mechanism has passed over the finger tips of the resilient fingers of said second tubular plug at which time the finger tips snap radially outwardly to thereby lock said second tubular plug and said second tubular locking mechanism to the protective barrier, the protective barrier being locked between a front end of said second tubular locking mechanism and the closed end of the second tubular plug; and an earphone electrically connected via an earphone cable and said closed end of the second tubular plug to said second electrical contact means so that said audio signal is received and audibly broadcast by said earphone.

5. The mounting structure of claim 1, further comprising a cylinder having an outer diameter substantially equal to an inner diameter of said tubular plug so that said cylinder fits coaxially inside said tubular plug.

6. The mounting structure of claim 5, wherein the cylinder supports the resilient fingers and prevents the resilient fingers from collapsing radially inwards.

7. The mounting structure of claim 5, further comprising an external alignment lug which projects radially outwardly from said cylinder for alignment with an alignment space located between two adjacent resilient fingers, said external alignment lug being arranged to prevent axial rotation of said cylinder with respect to said tubular plug whenever said external alignment lug is received in said alignment space.

8. The mounting structure of claim 5, further comprising an internal alignment lug which projects radially inwardly from said cylinder for alignment with a slot located on an electrical plug, said internal alignment lug being arranged to prevent axial rotation of said cylinder with respect to said electrical plug whenever said internal alignment lug is received in said slot.

9. The mounting structure of claim 5, further comprising an internal alignment lug which projects radially inwardly from said cylinder for alignment with a slot located on a microphone, said internal alignment lug being arranged to prevent axial rotation of said cylinder with respect to said microphone whenever said internal alignment lug is received in said slot.

10. The mounting structure of claim 5, farther comprising an external chamfer at an outside end of said cylinder.

* * * * *